US007592573B2

(12) United States Patent
Sim et al.

(10) Patent No.: US 7,592,573 B2
(45) Date of Patent: Sep. 22, 2009

(54) MICROWAVE COOKER COMPRISING A MULTI-STAGE CHOKE SEAL

(75) Inventors: Sung-Hun Sim, Gyeonggi-Do (KR); Eung-Su Kim, Seoul (KR); Jin-Yul Hu, Seoul (KR)

(73) Assignee: LG Electronics Inc., Seoul (KR)

( * ) Notice: Subject to any disclaimer, the term of this patent is extended or adjusted under 35 U.S.C. 154(b) by 83 days.

(21) Appl. No.: 11/331,020

(22) Filed: Jan. 13, 2006

(65) Prior Publication Data

US 2007/0012689 A1 Jan. 18, 2007

(30) Foreign Application Priority Data

Jul. 13, 2005 (KR) ..... 10-2005-0063401

(51) Int. Cl.
*H05B 6/76* (2006.01)

(52) U.S. Cl. ..... 219/741; 219/742; 174/377; 174/387

(58) Field of Classification Search ..... 219/739–744; 174/377–387

See application file for complete search history.

(56) References Cited

U.S. PATENT DOCUMENTS

| | | | | |
|---|---|---|---|---|
| 4,313,044 | A * | 1/1982 | Staats | 219/742 |
| 4,471,194 | A | 9/1984 | Hosokawa et al. | |
| 4,689,460 | A | 8/1987 | Ishino et al. | |
| 6,538,241 | B1 | 3/2003 | Filipsson | |
| 2003/0141298 | A1 * | 7/2003 | Lee et al. | 219/741 |

FOREIGN PATENT DOCUMENTS

| | | | |
|---|---|---|---|
| CN | 1335042 | A | 2/2002 |
| GB | 2 175 179 | A | 11/1986 |
| WO | WO-00/36878 | A1 | 6/2000 |

* cited by examiner

*Primary Examiner*—Quang T Van
(74) *Attorney, Agent, or Firm*—Birch, Stewart, Kolasch & Birch, LLP

(57) ABSTRACT

A microwave cooker comprises a body having a cooking chamber therein, the cooking chamber having one opened side, a microwave source disposed at the body for supplying microwave to the cooking chamber, a door coupled to the body for opening and closing the cooking chamber, and a multi-stage choke seal formed at the door and having different resonant frequencies and different LC resonant circuits for preventing the microwave from being leaked between the body and the door.

28 Claims, 9 Drawing Sheets

CONVENTONAL ART

MICROWAVE COOKER COMPRISING A MULTI-STAGE CHOKE SEAL

BACKGROUND OF THE INVENTION

1. Field of the Invention

The present invention relates to a microwave cooker, and more particularly, to a microwave cooker capable of effectively preventing a microwave leakage by enhancing a microwave damping function.

2. Description of the Background Art

A microwave cooker such as a microwave oven, an electric oven, etc. serves to heat and cook food by scanning microwave generated from a magnetron to the food.

The microwave cooker generally comprises a body having a cooking chamber, and a door coupled to the body for opening and closing the cooking chamber. A gap is formed between the body and the door.

When microwave is leaked through the gap between the body and the door, the microwave does harm to a user's body. Therefore, a microwave leakage from the cooking chamber has to be prevented.

Various methods for preventing the microwave from being leaked from the cooking chamber through the gap between the body and the door have been proposed, in which a capacitive seal, a choke seal, or a ferrite rubber is installed between the body and the door.

The conventional method will be explained in more detail with reference to FIG. 1.

FIG. 1 is a graph showing a microwave damping curve of a microwave cooker in accordance with the conventional art, in which 'A' expressed as decibel (dB) denotes a damping degree according to a frequency (f) when the cooking chamber is closed.

In the conventional microwave cooker, a choke seal is formed at the door as a closed curve that surrounds a circumference of an opening of the cooking chamber of the body, and has a depth corresponding to ¼ of a wavelength in order to serve as a shielding portion of microwave. When the cooking chamber of the body is closed by the door, a resonant frequency (f-1) of the choke seal has the same frequency as a central frequency (f-MGT: magnetron) of microwave.

When the cooking chamber is opened, a microwave source for supplying microwave is turned off.

However, in the conventional microwave cooker, microwave is drastically leaked when the door is initially opened.

That is, before the microwave source is completely turned off, the door is opened for a certain section. As the gap between the body and the door is increased when the cooking chamber is initially opened, an electromagnetic characteristic is changed. Accordingly, as shown in FIG. 1, the microwave damping curve is moved to the left side, and thus a damping is performed at a region having an inferior damping function. Therefore, microwave is much leaked through the gap between the body and the door.

The U.S. Pat. No. 6,538,241 (hereinafter, will be referred to as the conventional microwave cooker) discloses a microwave sealing unit for stably performing a damping at a wide frequency region.

The microwave sealing unit has a double resonant structure having two sealing cavities, and a resonant frequency of each cavity is positioned at both sides of a central frequency of microwave. As each resonant frequency has a constant gap therebetween, a gap variation of the door is not greatly influential thereon and thus a damping function can be stably performed at a wide frequency region.

However, in the conventional microwave cooker, as each resonant frequency of the microwave sealing unit is spaced from each other in order to obtain a wide bandwidth, a damping function is lowered at a region between each resonant frequency. Furthermore, since a central frequency of microwave is positioned at a region having an inferior damping function, an optimum damping function of the microwave cooker is not implemented.

The wider a gap between each resonant frequency is (that is, the wider a bandwidth is), the lower a damping function between each resonant frequency is. Therefore, when the gap between the body and the door is more than approximately 4 mm, it is difficult to effectively prevent a microwave leakage.

In the conventional microwave cooker, odor, smoke, etc. generated from food inside the cooking chamber contaminate an inner surface of the door, especially, the choke seal or the microwave sealing unit, and the contaminated portion is not easily cleaned.

BRIEF DESCRIPTION OF THE INVENTION

Therefore, an object of the present invention is to provide a microwave cooker capable of enhancing a microwave leakage blocking function and easily cleaning inside of a body.

To achieve these and other advantages and in accordance with the purpose of the present invention, as embodied and broadly described herein, there is provided a microwave cooker, comprising: a body having a cooking chamber therein, the cooking chamber having one opened side; a microwave source disposed at the body for supplying microwave to the cooking chamber; a door coupled to the body for opening and closing the cooking chamber; and a multi-stage choke seal formed at the door and having different resonant frequencies and different LC resonant circuits for preventing the microwave from being leaked between the body and the door.

The multi-stage choke seal comprises a first choke seal and a second choke seal cascaded to be in parallel with each other.

One choke seal of the multi-stage choke seal has an LC resonant circuit comprising an inductance (L) and a capacitance (C) connected to the inductance in series. Another choke seal of the multi-stage choke seal has an LC resonant circuit comprising an inductance (L) and a capacitance (C) connected to the inductance in parallel.

The first choke seal is disposed at an inner side of the multi-stage choke seal along a plate surface direction of the door, and the second choke seal is disposed at an outer side of the multi-stage choke seal along the plate surface direction of the door. An LC resonant circuit of the first choke seal comprises an inductance and a capacitance connected to the inductance in series. An LC resonant circuit of the second choke seal comprises an inductance and a capacitance connected to the inductance in parallel.

The multi-stage choke seal comprises a groove formed at a circumferential portion of the door and having a first cavity and a second cavity separated from each other by a partition wall, each cavity having an opening towards a front surface of the body; a first control plate extending from the partition wall for partially covering the opening of the first cavity of the first choke seal; and slots formed at the first control plate in a circumferential direction of the door with a certain interval.

The multi-stage choke seal further comprises a slit connected to the slot and formed at the partition wall.

The multi-stage choke seal further comprises a second control plate extending from a side wall of the groove for partially covering the opening of the second cavity of the second choke seal.

The multi-stage choke seal further comprises a third control plate extending from the second control plate towards an inner side of the second cavity.

When the cooking chamber is closed by the door, the first choke seal has a resonant frequency at a frequency region higher than the central frequency of the microwave.

A difference between a resonant frequency of the first choke seal and a resonant frequency of the second choke seal is 500 MHz to 800 MHz.

A difference between the resonant frequency of the first choke seal and the central frequency of the microwave is within 250 MHz.

When the door is initially opened, the resonant frequency of the first choke seal is approximately the central frequency of the microwave.

Preferably, a transparent window is coupled to the door so as to be disposed between the door and the body.

The transparent window has a size corresponding to a size of a front surface of the body.

The first control plate and the second control plate are disposed on the same plane along a plate surface direction of the door.

The first control plate and the second control plate are formed along a plate surface direction of the door so as to have a height difference corresponding to a thickness of the transparent window. The transparent window is disposed on the same plane as the second control plate.

The microwave cooker further comprises a sealing member disposed at an interface between the transparent window and the second control plate.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
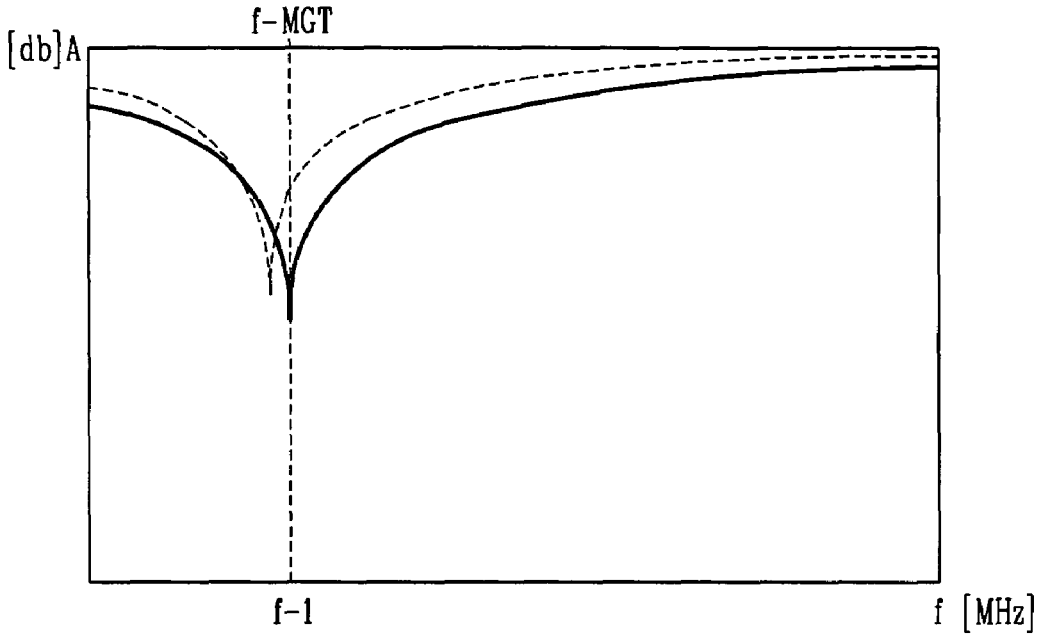
FIG. 1 is a graph showing a microwave damping curve of a microwave cooker in accordance with the conventional art.
Figure 2:
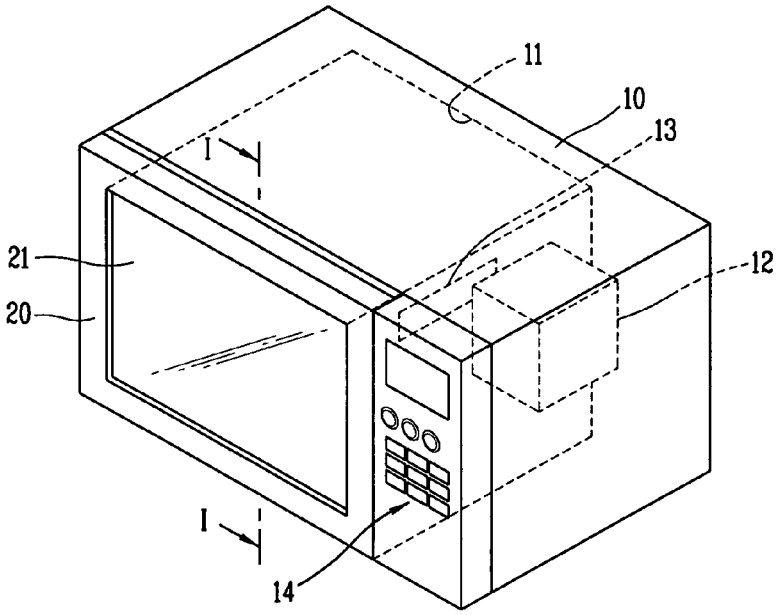
FIG. 2 is a perspective view showing a structure of a microwave cooker according to the present invention.
Figure 3:
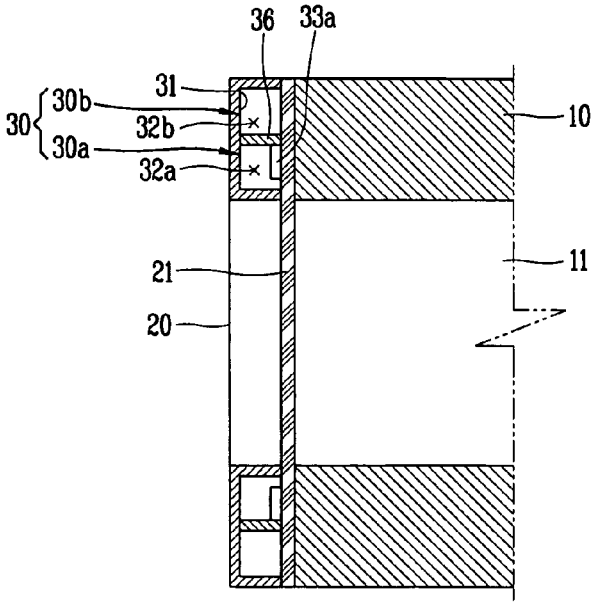
FIG. 3 is a sectional view taken along line I-I of FIG. 2.
Figure 4:
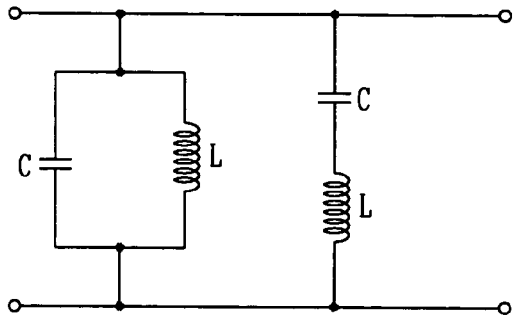
FIG. 4 is an LC resonant circuit diagram applied to a multi-stage choke seal of the microwave cooker according to the present invention.

Reference will now be made in detail to the preferred embodiments of the present invention, examples of which are illustrated in the accompanying drawings.

Hereinafter, a microwave cooker of the present invention will be explained with reference to the attached drawings.

Referring to FIGS. 2 to 12, the microwave cooker of the present invention comprises a body 10 forming an appearance and having a cooking chamber 11 therein, the cooking chamber having one opened side for cooking food, a microwave source 12 disposed at the body 10 for supplying microwave to the cooking chamber 11, a door 20 rotatably coupled to a front surface of the body 10 for opening and closing the cooking chamber 11, and a multi-stage choke seal 30 formed at the door 20, having different resonant frequencies (f-1, f-2), and having different LC resonant circuits for preventing the microwave from being leaked between the body 10 and the door 20.

A microwave supplying unit 13 for supplying microwave generated from the microwave source 12 is disposed at the body 10, and an adjustment unit 14 for controlling each kind of component and selecting a cooking mode is installed at a right side of a front surface of the body 10.

The multi-stage choke seal 30 comprises a first choke seal 30*a* and a second choke seal 30*b* cascaded to be in parallel with each other. The first choke seal 30*a* and the second choke seal 30*b* have different LC resonant circuits.

That is, one of the first choke seal 30*a* and the second choke seal 30*b* of the multi-stage choke seal 30 is a short type choke seal provided with an LC resonant circuit comprising an inductance (L) and a capacitance (C) connected to the inductance at a resonant portion in series. Another of the first choke seal 30*a* and the second choke seal 30*b* of the multi-stage choke seal is an open type choke seal provided with an LC resonant circuit comprising an inductance (L) and a capacitance (C) connected to the inductance at a resonant portion in parallel.

Hereinafter, will be explained a structure in which the first choke seal 30*a* is disposed at an inner side of the multi-stage choke seal 30 along a plate surface direction of the door 20, the second choke seal 30*b* is disposed at an outer side of the multi-stage choke seal 30 along the plate surface direction of the door 20, the first choke seal 30*a* is a short type choke seal, and the second choke seal 30*b* is an open type choke seal.

The short-type first choke seal 30*a* directly blocks a microwave leakage from a gap between the body 10 and the door 20. The open-type second choke seal 30*b* does not directly block a microwave leakage from a gap between the body 10 and the door 20, but has a resonance frequency (f-2) at a frequency region lower than a resonance frequency (f-1) of the first choke seal 30*a*. The open-type second choke seal 30*b* influences on the first choke seal 30*a*, widens a bandwidth, lowers a microwave damping level inside the first choke seal 30*a*, and enhances a microwave damping function.

Figure 5:
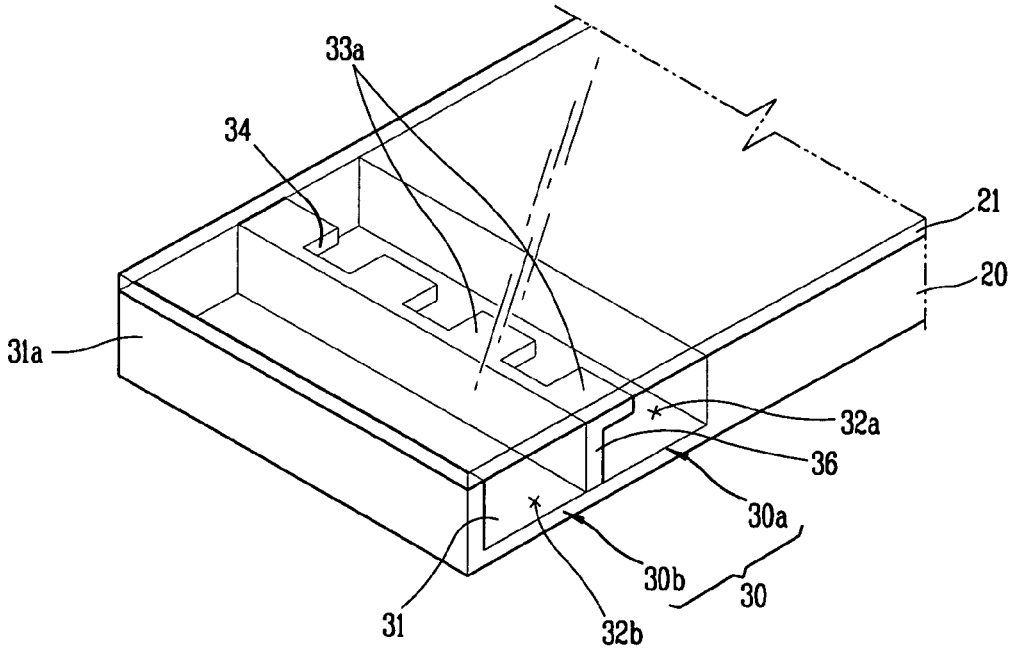
FIGS. 5 to 8 are perspective views showing a structure of the multi-stage choke seal of the microwave cooker according to the present invention.

As shown in FIG. 5, the multi-stage choke seal 30 comprises a groove 31 formed at a circumferential portion of the door 20 and having a first cavity 32*a* and a second cavity 32*b* separated from each other by a partition wall 36, each cavity having an opening towards a front surface of the body 10, a first control plate 33*a* extending from the partition wall 36 for partially covering the opening of the first cavity 32*a* of the first choke seal 30*a*, and slots 34 formed along a progressive direction of the microwave and formed at the first control plate 33*a* in a circumferential direction of the door 20 with a certain interval.

The partition wall 36 is fixed to a lower surface of the groove 31 in parallel with a side wall 31*a* of the groove 31 by a welding or a screw joint. The resonant frequency (f-1) of the first choke seal 30*a* can be varied by controlling a structure, a size, etc. of each portion corresponding to the inductance L and the capacitance C.

The second cavity 32*b* of the second choke seal 30*b* has an electric length corresponding to ¼ of a wavelength 1 when the cooking chamber 11 is closed by the door 20. The resonant frequency (f-2) of the second choke seal 30*b* can be varied by controlling a structure, a size, etc. of the second cavity 32*b* so that the inductance L and the capacitance C can be varied.

The resonant frequency (f-2) of the second choke seal 30*b* can be varied by controlling a structure, a size, etc. of each portion corresponding to the inductance L and the capacitance C.

Figure 6:
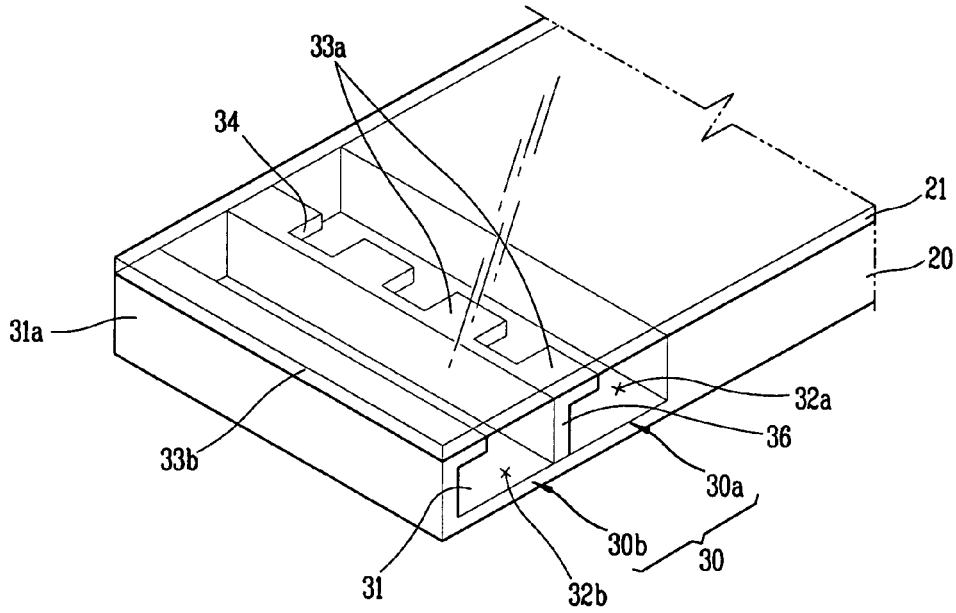
Figure 7:
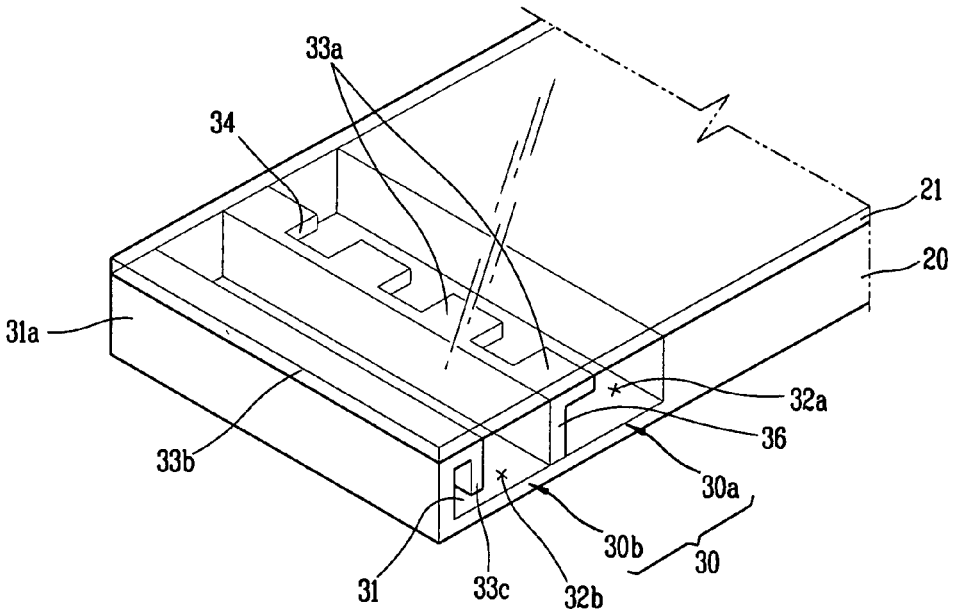

As shown in FIG. 6, the second choke seal 30*b* can further comprise a second control plate 33*b* extending from the side wall 31*a* of the groove 31 for partially covering the opening of the second cavity 32*b*. As shown in FIG. 7, the second choke seal 30*b* can further comprise a third control plate 33*c* extending from the second control plate 33*b* towards an inner side of the second cavity 32*b*. Accordingly, the second choke seal 30*b* can have an enough electric length without an increased width (when a width of each choke seal 30*a* and 30*b* is increased, a height and a width of the cooking chamber 11 is decreased).

In the microwave cooker according to the first embodiment of the present invention, when the cooking chamber 11 of the body 10 is closed by the door 20, the central frequency (f-MGT) of microwave is 2450 MHz. When the cooking chamber 11 of the body 10 is closed by the door 20, the resonant frequency (f-1) of the first choke seal 30*a* is approximately equal to the central frequency (f-MGT) of microwave, and is formed at a frequency region higher than the central frequency (f-MGT) of the microwave.

That is, if the resonant frequency (f-1) of the first choke seal 30*a* is approximately equal to the central frequency (f-MGT) of microwave, an optimum microwave damping function provided from the multi-stage choke seal 30 is implemented when the cooking chamber 11 of the body 10 is closed by the door 20. Also, if the resonant frequency (f-1) of the first choke seal 30*a* is formed at a frequency region higher than the central frequency (f-MGT) of the microwave, an optimum microwave damping function provided from the multi-stage choke seal 30 is implemented when the door 20 is initially opened (that is, when the door 20 is opened for a certain section before the microwave source 12 is completely turned off, and thus when a gap is generated between the body 10 and the door 20).

Figure 9:
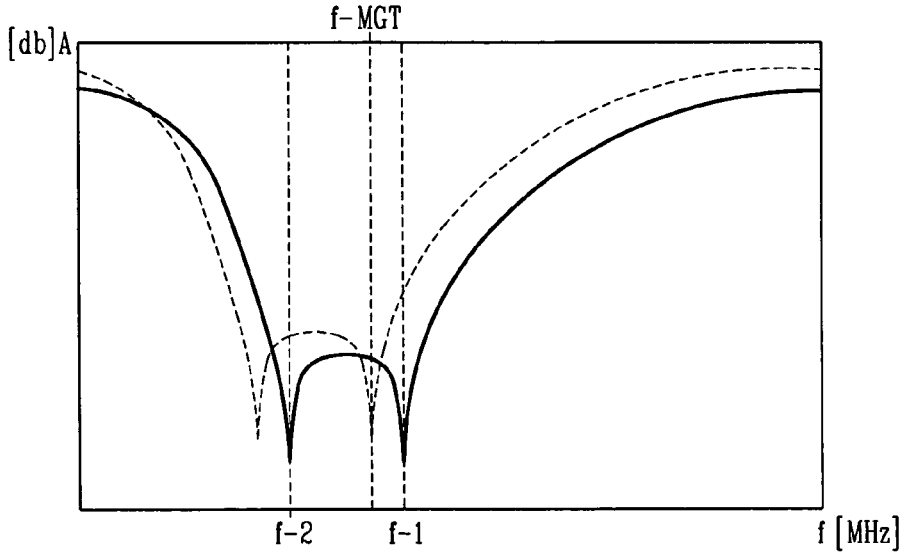
FIG. 9 is a graph showing a microwave damping curve by the multi-stage choke seal of the microwave cooker according to the present invention.

Hereinafter, as shown in FIG. 9, a case that the first choke seal 30*a* has the resonant frequency (f-1) at a frequency region higher than the central frequency (f-MGT) of microwave when the cooking chamber 11 is closed by the door 20 will be explained.

When the resonant frequency (f-1) of the first choke seal 30*a* is formed at a frequency region higher than the central frequency (f-MGT) of the microwave, a difference between the resonant frequency (f-1) of the first choke seal 30*a* and the resonant frequency (f-2) of the second choke seal 30*b* is 500 MHz to 800 MHz.

That is, when the resonant frequency (f-1) of the short-type first choke seal 30*a* having a maximum magnetic field is closer to the resonant frequency (f-2) of the open-type second choke seal 30*b* having a maximum electric field at a resonance position, an interference is generated therebetween due to the magnetic/electric characteristics of the first choke seal 30*a* and the second choke seal 30*b* and thus the first and second choke seals are unstably operated. Therefore, the first choke seal 30*a* and the second choke seal 30*b* have to be spaced from each other so that a difference between the resonant frequency (f-1) of the first choke seal 30*a* and the resonant frequency (f-2) of the second choke seal 30*b* can be 500 MHz to 800 MHz, more preferably, 600 MHz to 700 MHz.

A difference between the resonant frequency (f-1) of the first choke seal 30*a* and the central frequency (f-MGT) of microwave is within 250 MHz.

When the door is initially opened, the resonant frequency of the choke seal of the microwave cooker is generally moved within a range of approximately 200 MHz. If a difference between the resonant frequency (f-1) of the first choke seal 30*a* and the central frequency (f-MGT) of the microwave is more than 250 MHz, an optimum microwave damping function provided from the multi-stage choke seal 30 is not implemented when the door 20 is initially opened. Therefore, the difference between the resonant frequency (f-1) of the first choke seal 30*a* and the central frequency (f-MGT) of the microwave has to be within 250 MHz.

In order to implement an optimum microwave damping function when the door 20 is initially opened, the resonant frequency (f-1) of the first choke seal 30*a* is constructed to be approximately equal to the central frequency (f-MGT) of the microwave.

A leakage amount (L) of microwave is increased in proportion to a cube of a gap G between the body 10 and the door 20 when the gap is less than a wavelength (λ) of microwave. Therefore, when the cooking chamber 11 is closed by the door 20, the leakage amount (L) from the gap becomes different according to a tuned position of the resonant frequency (f-1) of the first choke seal 30*a*.

Figure 10:
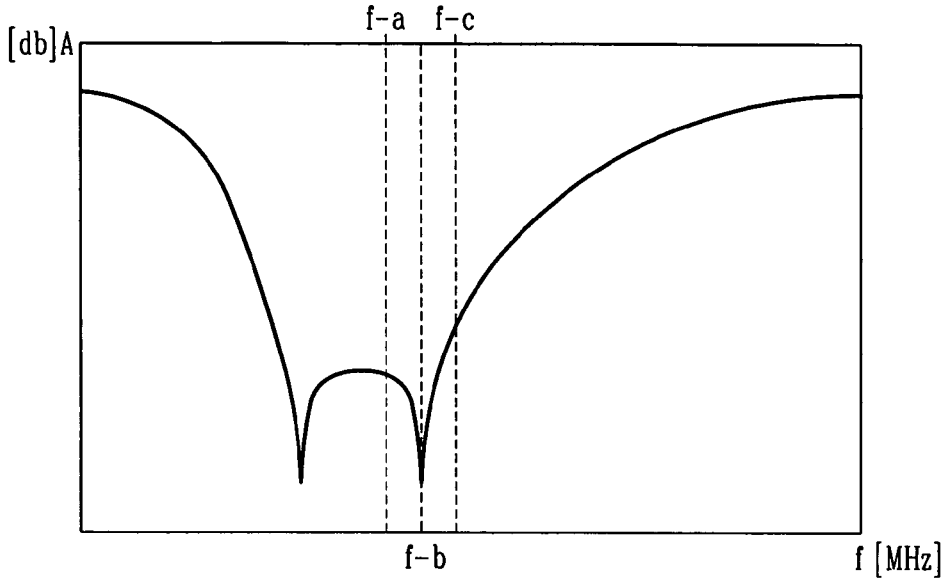
FIGS. 10 and 11 are views for explaining a principle of the multi-stage choke seal applied to FIGS. 2 to 9.
Figure 11:
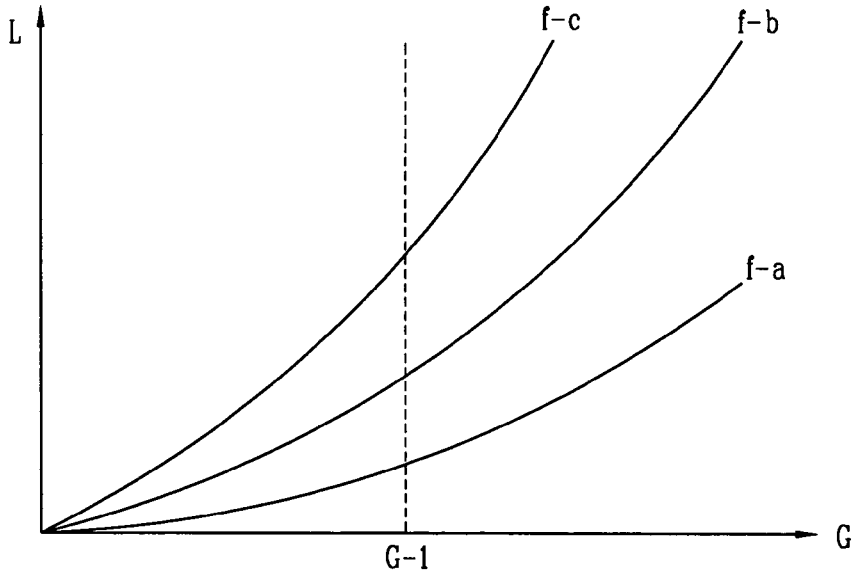

As shown in FIGS. 10 and 11, when the cooking chamber 11 is closed by the door 20, the leakage amount (L) from the gap G between the body 10 and the door 20 becomes different according to a tuned position of the resonant frequency (f-1) of the first choke seal 30*a* among f-a, f-b, and f-c. In the present invention, the resonant frequency (f-1) of the first choke seal 30*a* is tuned to be positioned at the f-a region, thereby effectively blocking a microwave leakage from a gap (G-1) by which the microwave source 12 is turned off when the door 20 is opened.

Figure 12:
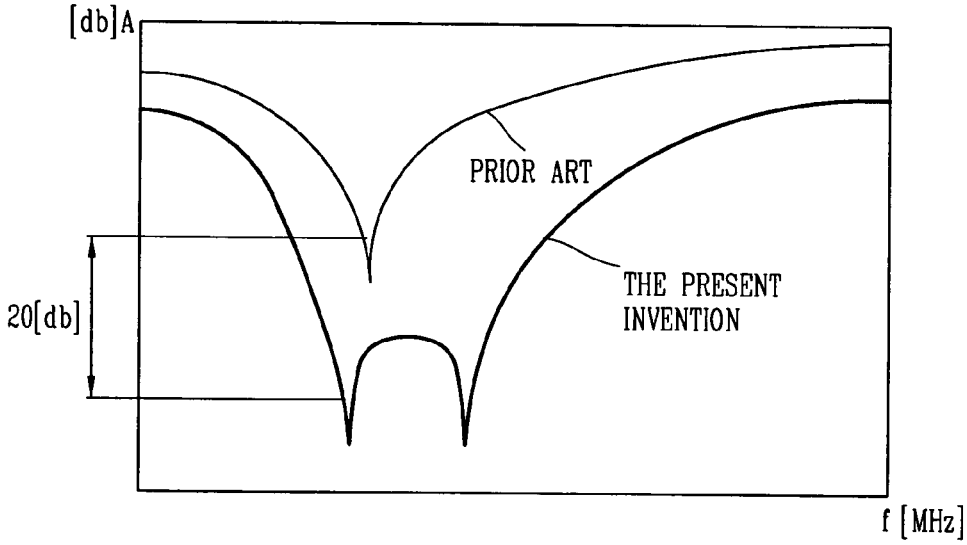
FIG. 12 is a view for comparing a microwave damping curve by the multi-stage choke seal of the microwave cooker according to the present invention with a conventional microwave damping curve.

In the microwave cooker according to the first embodiment of the present invention, the choke seals 30*a* and 30*b* of the multi-stage choke seal 30 having different resonant frequencies f-1 and f-2 are composed of different LC resonant circuits. The open-type second choke seal 30*b* has the resonant frequency f-2 at a frequency region lower than the resonant frequency f-1 of the short-type first choke seal 30*a*. Accordingly, as shown in FIG. 12, a microwave damping function is increased by at least 20 dB when compared with the conventional damping function, and a microwave leakage blocking function is enhanced according to a variation of the gap between the body 10 and the door 20 is enhanced. Also, even if a gap between the first choke seal 30*a* and the second choke seal 30*b* is not wide, an enhanced microwave damping function can be obtained.

Furthermore, in the present invention, the resonant frequency f-1 of the first choke seal 30*a* is disposed at a frequency region higher than the central frequency (f-MGT) of microwave, and has the same frequency as the central frequency (f-MGT) of microwave when the door 20 is initially opened. Therefore, even if a gap between the body 10 and the door 20 is generated before the microwave source 12 is completely turned off when the door 20 is initially opened, an optimum damping function provided from the multi-stage choke seal 30 can be implemented. Also, even if a large gap more than approximately 4 mm is generated between the body 10 and the door 20, a microwave leakage blocking is effectively performed.

Figure 8:
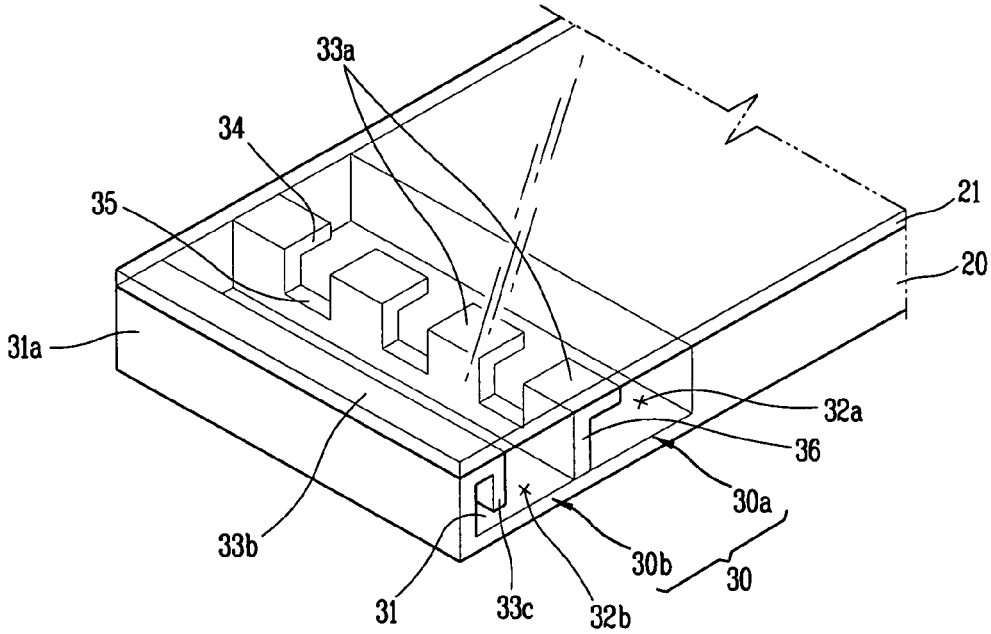

As shown in FIG. 8, the multi-stage choke seal 30 according to the first embodiment of the present invention further comprises a slit 35 connected to the slot 34 and formed at the partition wall 36 with a certain depth. A microwave damping function can be stably implemented according to a variation of an incident angle of electromagnetic wave by the slit 35.

A transparent window 21 for viewing inside of the cooking chamber 11 is formed of glass, plastic, etc., and is coupled to the door 20.

The transparent window 21 has a size corresponding to a size of a front surface of the body 10. The first control plate 33*a* and the second control plate 33*b* are disposed on the same plane along a plate surface direction of the door 20 so as to come in contact with the transparent window 21.

An inner surface of the door 20 is entirely covered by the transparent window 21, so that an additional choke cover (not shown) for covering the multi-stage choke seal 30 is not required and the inner surface of the door 20 has an improved design. Furthermore, the inner surface of the door 20, especially, the choke seal 30 that is not easily cleaned is prevented from being contaminated by odor, smoke, etc. generated from food inside the cooking chamber 11, and the door 20 can be easily cleaned.

A microwave cooker according to another embodiment of the present invention will be explained with reference to FIGS. 13 to 16.

The same reference numerals were given to the same parts as those of the aforementioned microwave cooker, and detail explanation thereof will be omitted.

Figure 13:
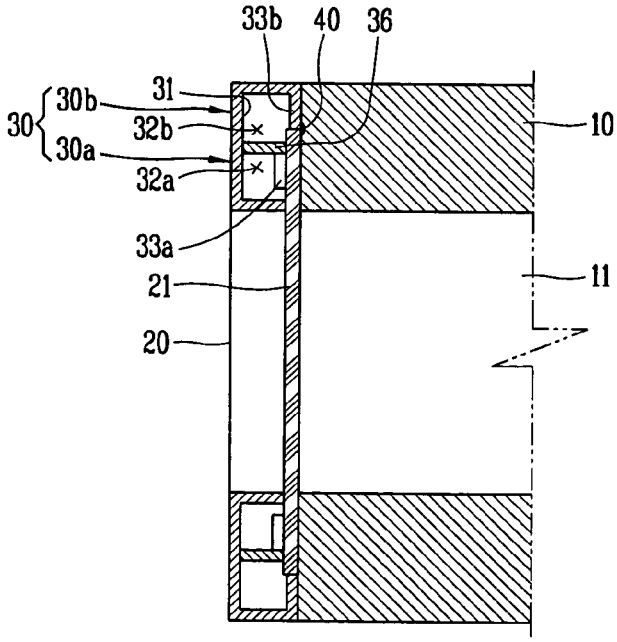
FIG. 13 is a sectional view showing a structure of a multi-stage choke seal of the microwave cooker according to another embodiment of the present invention.
Figure 14:
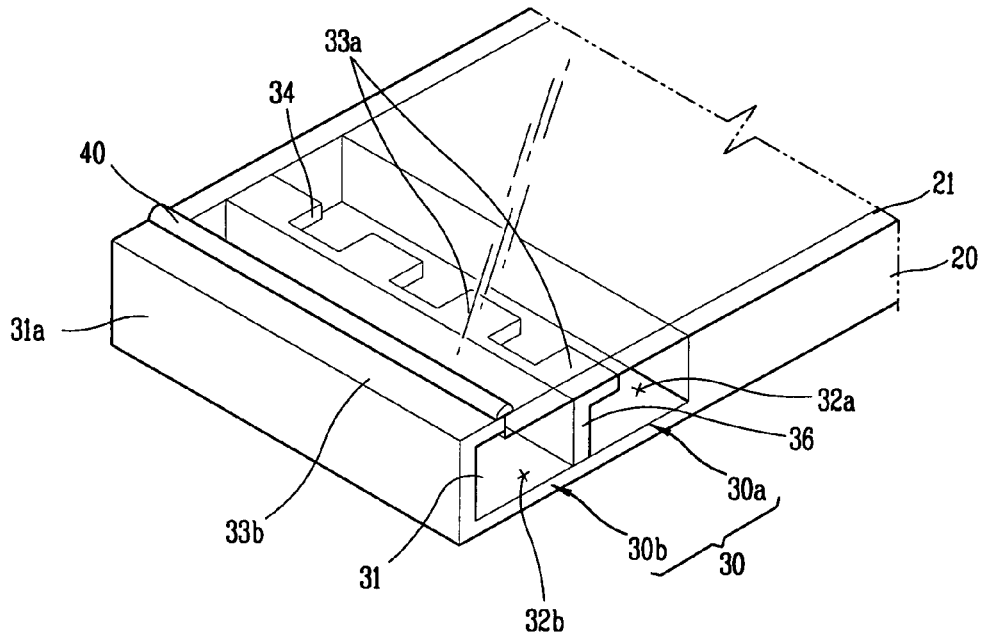
FIGS. 14 to 16 are perspective views showing a structure of a multi-stage choke seal of the microwave cooker according to still another embodiment of the present invention.

As shown in FIGS. 13 and 14, in the microwave cooker according to another embodiment of the present invention, the first control plate 33*a* of the first choke seal 30*a* and the second control plate 33*b* of the second choke seal 30*b* are formed along a plate surface direction of the door 20, and have a height difference along a thickness direction of the door 20. The transparent window 21 is disposed on the same plane as the second control plate 33*b*.

The second control plate 33*b* of the second choke seal 30*b* disposed at an outer side of the multi-stage choke seal 30 along a plate surface direction of the door 20 is formed in a thickness direction of the door 20, and is formed at a position higher than the first control plate 33*a* by a height difference corresponding to a thickness of the transparent window 21. The transparent window 21 has a size corresponding to an inner circumference of the second control plate 33*b*, and is disposed on the same plane as the second control plate 33*b*. The above structure is applied when the transparent window 21 is not entirely covered at the inner surface of the door 20. According to the structure, an additional choke (not shown) is not required, the inner surface of the door 20 has an improved design, and the door is easily cleaned.

Figure 15:
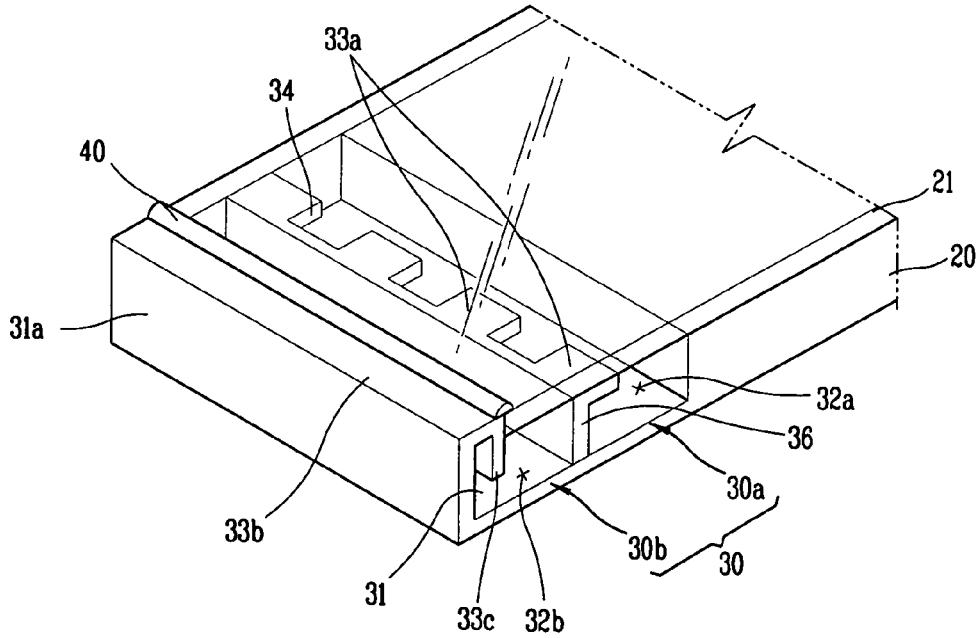

As shown in FIG. 15, the third control plate 33*c* is extending from the second control plate 33*b* of the second choke seal 30*b* towards an inner side of is the second cavity 32*b*. The second choke seal 30*b* can have a sufficient electric length without increasing a width thereof by the third control plate 33*c*. Also, the third control plate 33*c* supports an end portion of the transparent window thus to stably support the transparent window.

Figure 16:
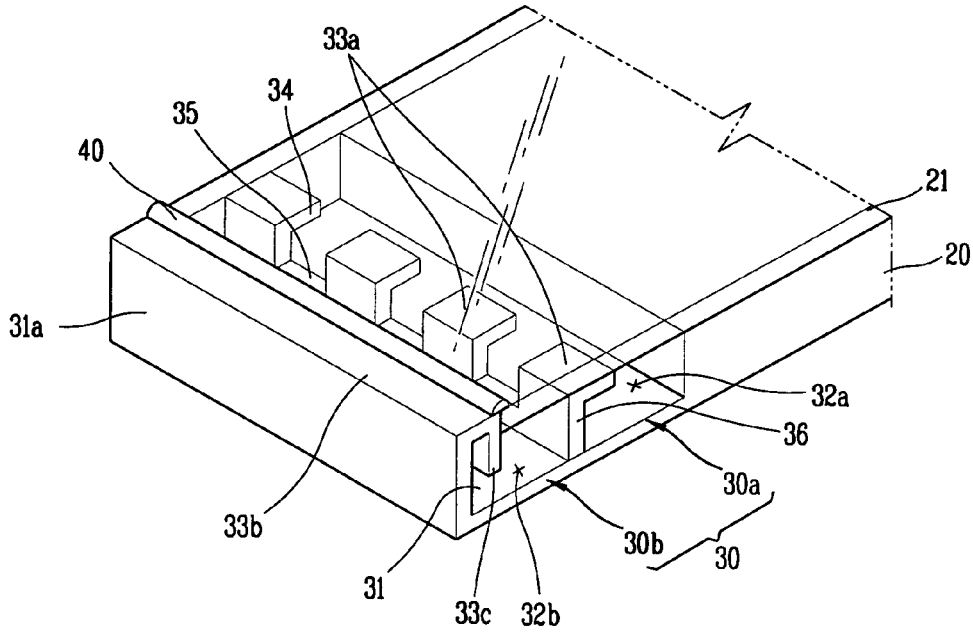
Figure 17:
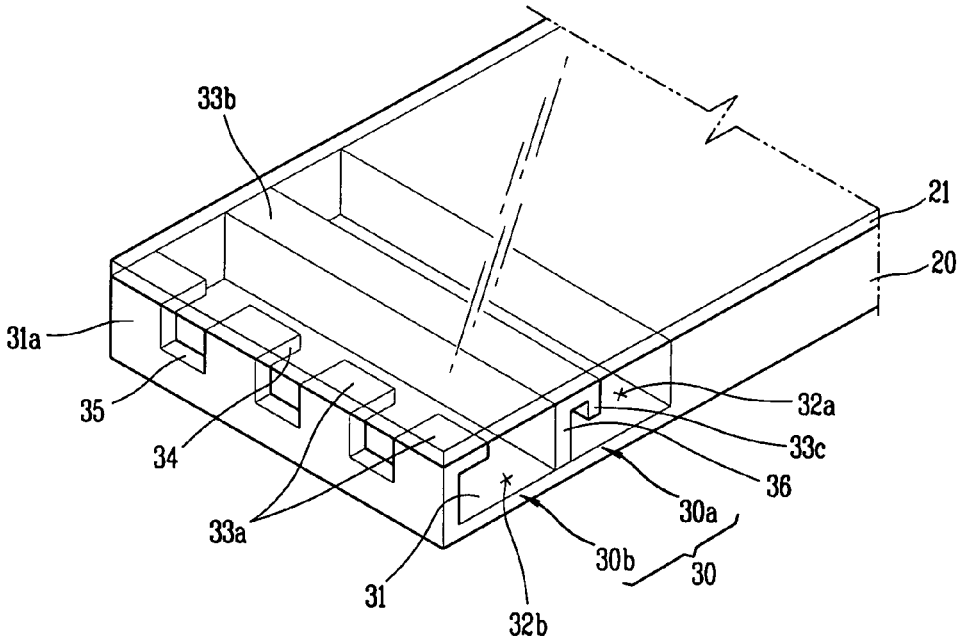
FIG. 17 is a perspective view showing a structure of a multi-stage choke seal of the microwave cooker according to yet still another embodiment of the present invention.

As shown in FIG. 16, the slit 35 for stably maintaining a microwave damping function according to a variation of an incident angle of an electromagnetic wave can be formed at the partition wall 36.

A sealing member 40 formed of a rubber, a silicon, etc. is provided at an interface between the transparent window 21 and the second control plate 33*b*. The sealing member 40 performs a damping function when the transparent window 21 comes in contact with the front surface of the body 10, and prevents odor, smoke, etc. generated from the cooking chamber 11 from being leaked out through the gap between the body 10 and the door 20. Also, the sealing member 40 closes the multi-stage choke seal 30.

The first choke seal 30*a* is disposed at an inner side of the multi-stage choke seal 30 along a plate surface direction of the door 20, and the second choke seal 30*b* is disposed at an outer side of the multi-stage choke seal 30 along the plate surface direction of the door 20. The first choke seal 30*a* is a short-type choke seal, and the second choke seal 30*b* is an open-type choke seal. However, it is also possible that the first choke seal 30*a* disposed at an inner side of the multi-stage choke seal 30 along a plate surface direction of the door 20 is an open-type choke seal, and the second choke seal 30*b* disposed at an outer side of the multi-stage choke seal 30 along the plate surface direction of the door 20 is a short-type choke seal.

As aforementioned, in the microwave cooker according to the present invention, a microwave leakage blocking function can be enhanced A microwave leakage blocking function can be stably implemented according to a variation of the gap between the body and the door by a microwave damping function enhanced than the conventional damping function. Also, even if the gap between the body 10 and the door 20 is generated, an optimum damping function is implemented thereby to effectively prevent a microwave leakage.

Furthermore, the inner surface of the door can have an improved design and the door can be easily cleaned.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A microwave cooker, comprising:

a body having a cooking chamber therein, the cooking chamber having one opened side;

a microwave source disposed at the body for supplying microwave to the cooking chamber;

a door coupled to the body for opening and closing the cooking chamber; and a multi-stage choke seal formed at the door and having different resonant frequencies and different LC resonant circuits for preventing the microwave from being leaked between the body and the door, wherein the multi-stage choke seal comprises a first choke seal and a second choke seal cascaded to be in parallel with each other, wherein the first choke seal of the multi-stage choke seal has an LC resonant circuit comprising only an inductance (L) and a capacitance (C) connected to the inductance in series, and the second choke seal of the multi-stage choke seal has an LC resonant circuit comprising only an inductance (L) and a capacitance (C) connected to the inductance in parallel.

2. The microwave cooker of claim 1, wherein the first choke seal is disposed at an inner side of the multi-stage choke seal along a plate surface direction of the door, the second choke seal is disposed at an outer side of the multi-stage choke seal along the plate surface direction of the door, an LC resonant circuit of the first choke seal comprises an inductance and a capacitance connected to the inductance in series, and an LC resonant circuit of the second choke seal comprises an inductance and a capacitance connected to the inductance in parallel.

3. The microwave cooker of claim 2, wherein the multi-stage choke seal comprises:

a groove formed at a circumferential portion of the door and having a first cavity and a second cavity separated from each other by a partition wall, each cavity having an opening towards a front surface of the body;

a first control plate extending from the partition wall for partially covering the opening of the first cavity of the first choke seal; and slots formed at the first control plate in a circumferential direction of the door with a certain interval.

4. The microwave cooker of claim 3, further comprising a slit connected to the slot and formed at the partition wall.

5. The microwave cooker of claim 4, further comprising a second control plate extending from a side wall of the groove for partially covering the opening of the second cavity of the second choke seal.

6. The microwave cooker of claim 5, further comprising a third control plate extending from the second control plate towards an inner side of the second cavity.

7. The microwave cooker of claim 1, wherein when the cooking chamber is closed by the door, the first choke seal has a resonant frequency corresponding to a central frequency of the microwave.

8. The microwave cooker of claim 1, wherein when the cooking chamber is closed by the door, the first choke seal has a resonant frequency at a frequency region higher than the central frequency of the microwave.

9. The microwave cooker of claim 8, wherein a difference between a resonant frequency of the first choke seal and a resonant frequency of the second choke seal is 500 MHz to 800 MHz.

10. The microwave cooker of claim 9, wherein a difference between the resonant frequency of the first choke seal and the central frequency of the microwave is within 250 MHz.

11. The microwave cooker of claim 10, wherein when the door is initially opened, the resonant frequency of the first choke seal is approximately the central frequency of the microwave.

12. The microwave cooker of claim 11, wherein a transparent window is coupled to the door so as to be disposed between the door and the body.

13. The microwave cooker of claim 12, wherein the transparent window has a size corresponding to a size of a front surface of the body.

14. The microwave cooker of claim 13, wherein the first control plate and the second control plate are disposed on the same plane along a plate surface direction of the door.

15. The microwave cooker of claim 12, wherein the first control plate and the second control plate are formed along a plate surface direction of the door so as to have a height difference corresponding to a thickness of the transparent window, and the transparent window is disposed on the same plane as the second control plate.

16. The microwave cooker of claim 15, further comprising a sealing member disposed at an interface between the transparent window and the second control plate.

17. A microwave cooker, comprising:

a body having a cooking chamber therein, the cooking chamber having one opened side;

a microwave source disposed at the body for supplying microwave to the cooking chamber;

a door coupled to the body for opening and closing the cooking chamber; and a multi-stage choke seal formed at the door for preventing the microwave from being leaked between the body and the door, the multi-stage choke seal comprising:

a groove formed at a circumferential portion of the door and having a first cavity and a second cavity separated from each other by a partition wall, each cavity having an opening towards a front surface of the body;

a first control plate extending from the partition wall or a side wall of the groove for partially covering the opening of one cavity of the first cavity and the second cavity; and slots formed at the first control plate in a circumferential direction of the door with a certain interval, wherein the multi-stage choke seal comprises a first choke seal and a second choke seal cascaded to be in parallel with each other, wherein the first choke seal of the multi-stage choke seal has an LC resonant circuit comprising only an inductance (L) and a capacitance (C) connected to the inductance in series, and the second choke seal of the multi-stage choke seal has an LC resonant circuit comprising only an inductance (L) and a capacitance (C) connected to the inductance in parallel.

18. The microwave cooker of claim 17, further comprising a second control plate extending from the partition wall or a side wall of the groove for partially covering the opening of another cavity of the first cavity and the second cavity.

19. The microwave cooker of claim 18, further comprising a third control plate extending from the second control plate towards an inner side of a cavity having the second control plate.

20. The microwave cooker of claim 19, further comprising a transparent window coupled to the door so as to be disposed between the door and the body.

21. The microwave cooker of claim 20, wherein the transparent window has a size corresponding to a size of a front surface of the body.

22. The microwave cooker of claim 21, wherein the first control plate and the second control plate are disposed on the same plane along a plate surface direction of the door.

23. The microwave cooker of claim 20, wherein the first control plate and the second control plate are formed along a plate surface direction of the door so as to have a height difference corresponding to a thickness of the transparent window, and the transparent window is disposed on the same plane as the second control plate.

24. The microwave cooker of claim 23, further comprising a sealing member disposed at an interface between the transparent window and the second control plate.

25. The microwave cooker of claim 17, wherein when the cooking chamber is closed by the door, one choke seal where the slots are formed has a resonant frequency at a frequency region higher than a central frequency of the microwave.

26. The microwave cooker of claim 25, wherein a difference between each resonant frequency of each choke seal of the multi-stage choke seal is 500 MHz to 800 MHz.

27. The microwave cooker of claim 26, wherein a difference between the resonant frequency of one choke seal where the slots are formed and the central frequency of the microwave is within 250 MHz.

28. The microwave cooker of claim 27, wherein when the door is initially opened, the resonant frequency of one choke seal where the slots are formed is approximately the central frequency of the microwave.

* * * * *